US006832446B1

(12) United States Patent
Lemire

(10) Patent No.: US 6,832,446 B1
(45) Date of Patent: Dec. 21, 2004

(54) SELF-LEVELING & CONVERTABLE PICTURES

(76) Inventor: Robert J. Lemire, P.O. Box 299, Kings Park, NY (US) 11754

( * ) Notice: Subject to any disclaimer, the term of this patent is extended or adjusted under 35 U.S.C. 154(b) by 0 days.

(21) Appl. No.: 10/727,883

(22) Filed: Dec. 5, 2003

(51) Int. Cl.[7] ..... A47G 1/18

(52) U.S. Cl. ..... 40/761; 40/748; 40/757; 248/493

(58) Field of Search ..... 248/493, 496; 40/746, 745, 748, 753, 754, 759, 757, 761, 765; 428/493, 496

(56) References Cited

U.S. PATENT DOCUMENTS

| | | | | | |
|---|---|---|---|---|---|
| 1,423,433 | A | * | 7/1922 | Ketchem | 40/715 |
| 3,955,790 | A | * | 5/1976 | Ballin | 248/489 |
| 5,082,230 | A | * | 1/1992 | Chang | 248/476 |
| 6,405,466 | B1 | * | 6/2002 | Lemire | 40/757 |

* cited by examiner

*Primary Examiner*—Cassandra Davis

(57) ABSTRACT

Pictures and picture backs are improved with the use of an easel back that is fashioned to be a double hook for hanging the picture on a wall. The double loop hanging system described in U.S. Pat. No. 6,405,466 is improved with the use of this device. The easel flap supports the picture on a surface and allows for the fastening of the picture onto the surface. When it is removed from the picture the easel flap provides a side adjusting means for hanging a picture level on a wall.

4 Claims, 4 Drawing Sheets

Section A-A

SELF-LEVELING & CONVERTABLE PICTURES

FIELD OF INVENTION

This invention generally relates to pictures with easel backs and is an improvement over U.S. Pat. No. 6,405,466 that has a self-leveling and convertible back on a picture. The convertible feature allows the picture to be either on a surface or hung on a wall. The easel flap can be removed from the back for hanging on a wall. This provides a stable form of hanging.

BACKGROUND OF THE INVENTION

This application is an improvement to U.S. Pat. No. 6,405,466. The background information for this improvement is exactly the same as it is for that patent.

SUMMARY OF THE INVENTION

It is the object of the present invention to provide a useful means for hanging a picture with a convertible back on the wall with the use of the easel flap as the hanger affixed to the wall. According to the present invention an easel flap is fashioned to support the picture while on a surface as well as when on a wall. The easel flap is made of a rigid material that has angled hooks at the ends.

When holding the picture on a surface one end of the easel flap is affixed to the back by inserting into a slot in the back. The easel flap then extends away from the back at such an angle that the opposite end lies flat on the surface. This flat portion can be used to affix the easel flap onto the surface to make sure the picture does not fall from the surface due to vibrations or incidental contact. When the picture is to be hung on a wall the easel flap is removed, affixed to the wall, and the two cord loops on the picture back are used to support the picture in a stable fashion on the wall. The easel flap has elongated holes for affixing it to the wall, and for providing a measure of horizontal adjustment.

DETAILED DESCRIPTION

The improved convertible picture back is an improvement over U.S. Pat. No. 6,405,466 where the formation of the interconnected cord loops is described. This application changes the easel flap from being a template into a combined easel flap and double wall hook.

Figure 1A:
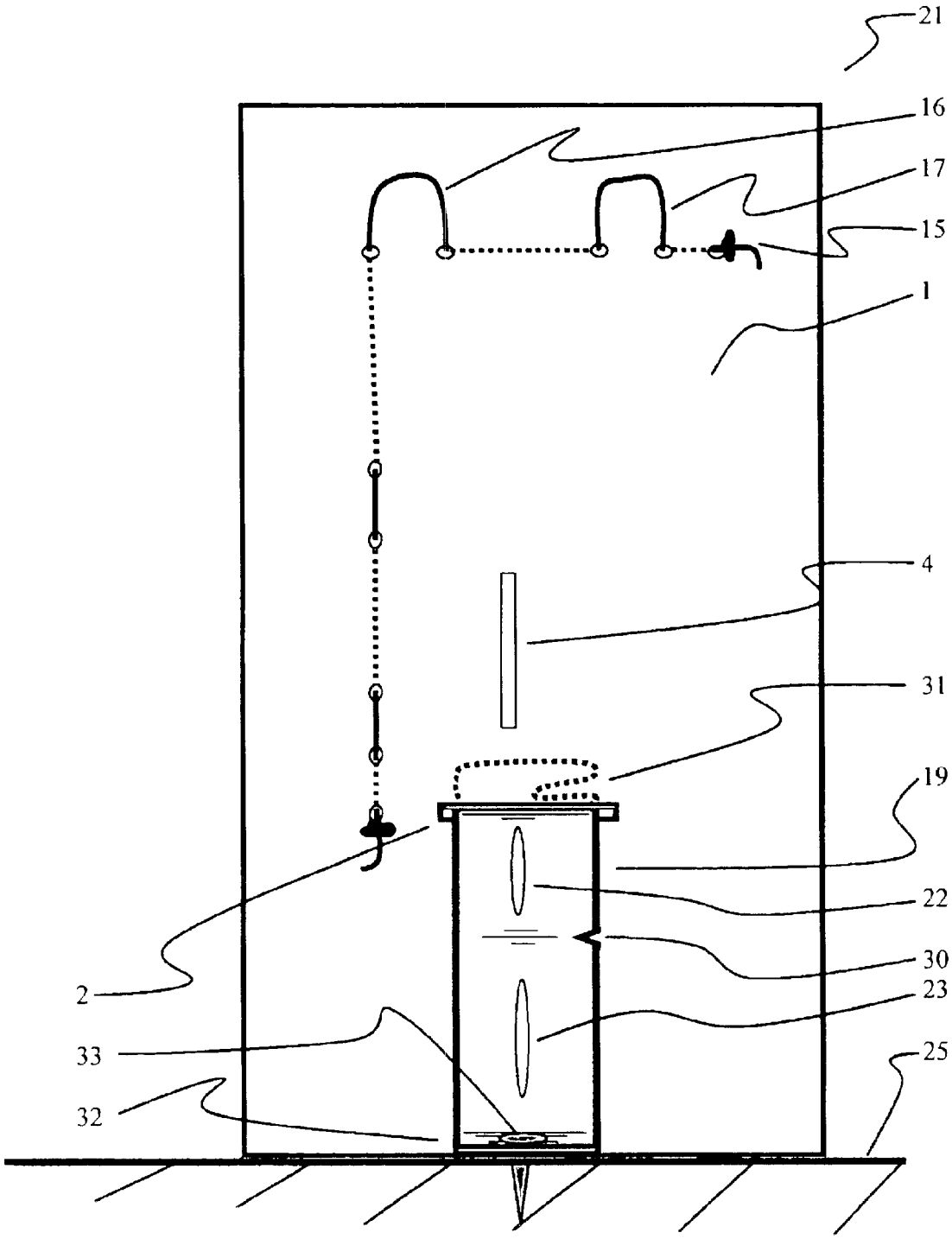
FIG. 1A is a back view of the picture back inserted into a picture frame.

With reference to FIGS. 1A, 1B, 1C & 1D, in which like numerals represent like parts, FIG. 1A shows a picture back 1 slid into picture frame 21 and supported on surface 25. The Picture back has Cord 15 forming cord loops 16 & 17 for holding the picture onto a wall. Double hook easel flap 19 has a top bent section 31 forming a hook and inserted into slot 2 or 4 depending upon the desired orientation of the picture 21. The bottom section 32 of double hook easel flap 19 is resting on surface 25 and can be held in position with fastener 33. The easel flap also has a middle point notch 30 and two slotted apertures 22 & 23.

Figure 1B:
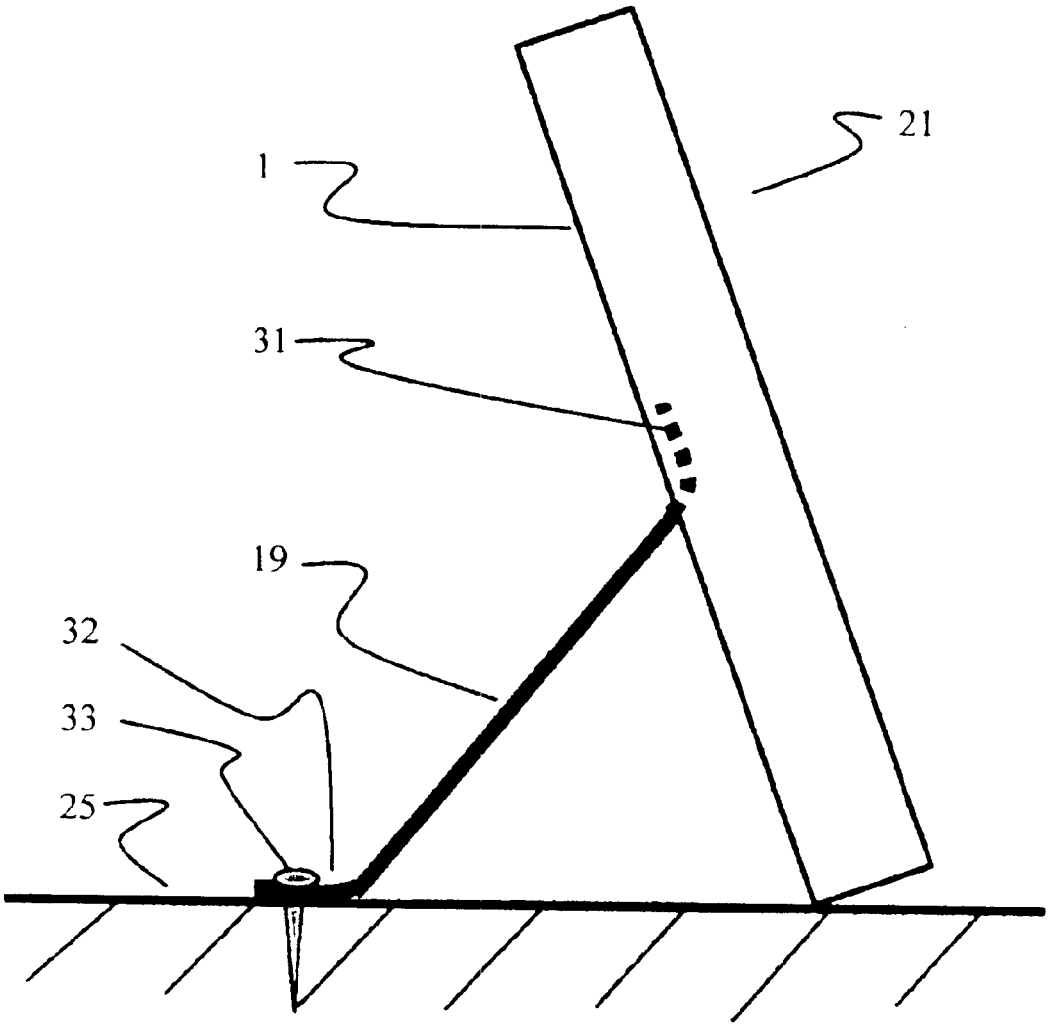
FIG. 1B is a side view of the picture supported at an angle by the easel flap.

With reference to FIG. 1B the double hook easel flap 19 has section 31 inserted through slot 2 in back 1 and extends down to section 32 affixed to surface 25 with fastener 33, and is holding picture 21 at a slight angle.

Figure 1C:
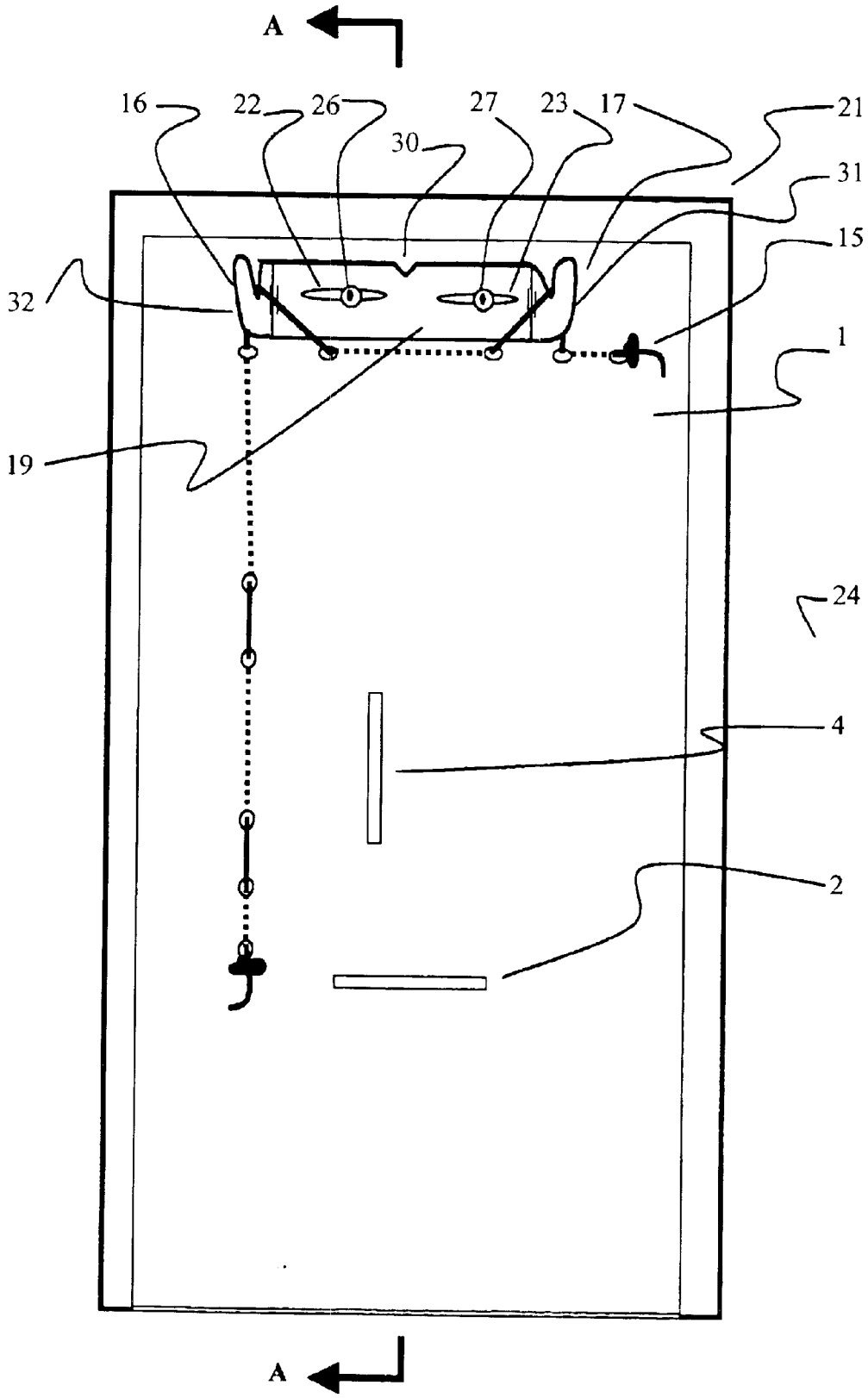
FIG. 1C is a view looking away from a wall toward the back of a picture attached to the wall.

With reference to FIG. 1C fasteners 26 & 27 are through slotted apertures 22 & 23 in the double hook easel flap 19 and extend into wall 24. Sections 31 & 32 of double hook easel flap 19 are holding cord loops 16 & 17 through picture back 1 as they support picture 21 on the wall 24. Also shown is the center notch 30 on double hook easel flap 19 and slots 2 & 4 in back 1.

Figure 1D:
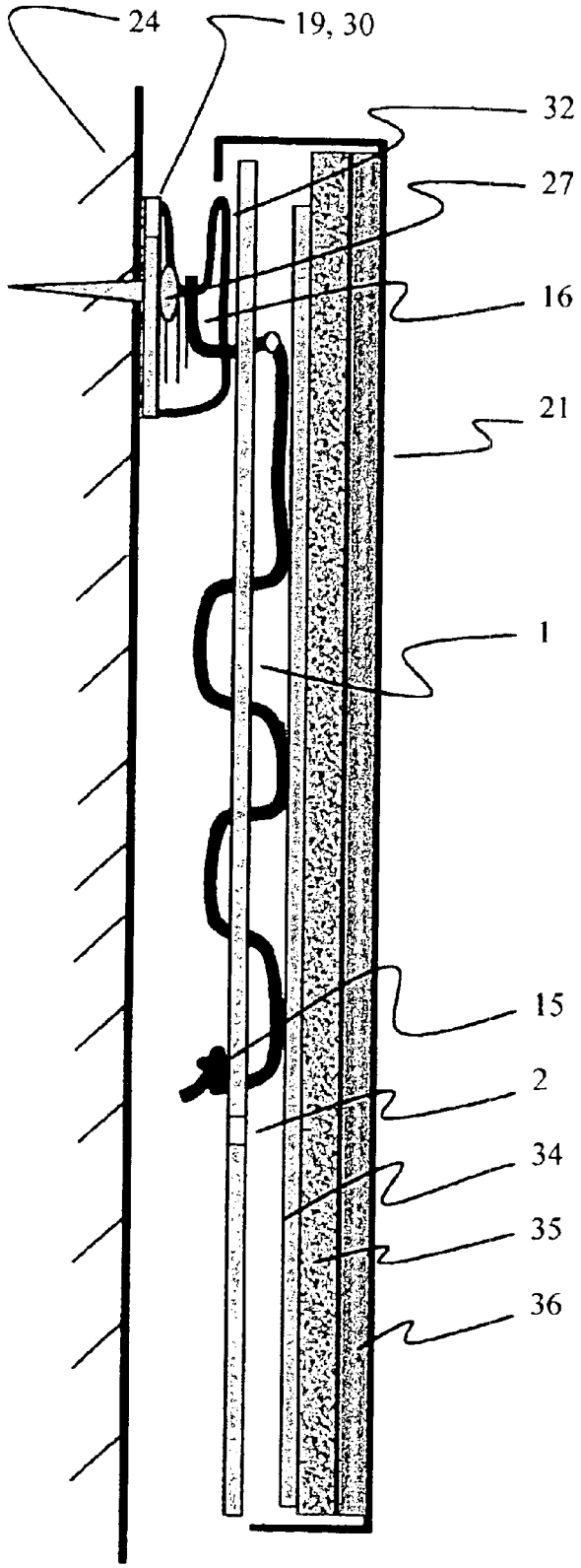
FIG. 1D is a vertical section of FIG. 1C.

With reference to FIG. 1D, picture 21 is hung on wall 24 with cord loop 16 over easel flap section 32 affixed to the wall with fastener 27. This drawing also shows spacer 34, the art or a photograph 35, and the glass 36 in picture 21.

When a picture 21 is hung on the double hook easel flap 19 mounted to a wall the double cord loops 16 & 17 allow the picture to be made level and to be held in a stable position. The height of the picture 21 can easily be changer by changing the length of the cord 15. The horizontal position of the picture can also be adjusted by changing the position of double hook easel flap 19 by loosening fasteners 26 & 27 and moving it sideways in the slotted apertures 22 & 23.

When picture 21 is standing on a surface 25 it can be fastened to that surface so that it does not alter its position due to vibrations or incidental contact.

While the invention has been described above with respect to certain embodiments thereof, it will be appreciated that variations and modifications may be made without departing from the spirit and scope of the invention. Some of these may take the form of fastening the easel flap to a riveted head in the picture back and the use of other means for forming the cord loops and affixing them to the picture.

What I claim is:

1. An improved picture display device comprising a flexible cord forming a plurality of adjustable interconnected hanging loops for slidingly engaging a double hook-easel, a picture back, said back having a series of apertures there-through in which the flexible cord is threaded, said cord being affixed to the back at at least one end thereof and forming the adjustable loops between pairs of adjacent apertures such that the loops are used for engaging the double hook-easel when affixed to a wall;

the double hook-easel is configured to be removably attached to the picture back to form an easel flap for holding the picture display device in an upright orientation on a horizontal surface and to be removably attached to a wall to form a hanger for engaging the loops for hanging the picture display device therefrom.

2. The picture display device of claim 1, wherein the double hook-easel has an aperture for securing the display device on the horizontal surface.

3. The picture display device of claim 1 wherein the double hook-easel is configured to have slots for affixing it to a wall using fasteners, thereby providing a means for horizontal positioning.

4. The picture display device of claim 1, wherein the back is configured to have a means for inserting and removing a picture without removing the back.

* * * * *